United States Patent [19]

Debrus

[11] 4,114,513

[45] Sep. 19, 1978

[54] STEP-BY-STEP CONTROLLED SERVOMECHANISM

[75] Inventor: Philippe Maurice Henri Debrus, Paris, France

[73] Assignee: D.B.A., Clichy, France

[21] Appl. No.: 680,599

[22] Filed: Apr. 26, 1976

[30] Foreign Application Priority Data

May 2, 1975 [FR] France ..... 75 13850

[51] Int. Cl.[2] ..... F15B 15/17; F15B 9/02

[52] U.S. Cl. ..... 91/19; 91/20; 91/357; 91/390; 91/417 R; 91/445

[58] Field of Search ..... 91/445, 398, 417 R, 91/357, 19, 20, 390

[56] References Cited

U.S. PATENT DOCUMENTS 3,732,027 5/1973 Lupke ..... 91/445

4,014,248 3/1977 Cyrot ..... 91/390

*Primary Examiner*—Paul E. Maslousky

[57] ABSTRACT

A step-by-step controlled servomechanism of the type comprising a drive element movable provided with a plurality of receiver ports, and a fixed distributor to supply said receiver ports and having a number of transmitter ports capable of being connected, in pairs, respectively to the low pressure and to the high pressure, a fixed manifold having a plurality of manifold ports capable of communicating with the chamber of the drive element, all the receiver ports being capable of being made to open in succession into one of said manifold ports, selecting means capable of connecting, in succession by permutation and simultaneously, at least one pair of transmitter ports to the high pressure and to the low pressure, respectively, and at least one manifold port to the chamber of the drive element.

4 Claims, 9 Drawing Figures

STEP-BY-STEP CONTROLLED SERVOMECHANISM

There has been described in U.S. Pat. application Ser. No. 584,286, now U.S. Pat. No. 4,014,248 which documents will be termed hereinafter "known patent", a step-by-step controlled servomechanism of the type comprising, on one hand, a drive element movable in a case, which it divides into two chambers, and provided with a plurality of receiver ports (receiving means), and, on the other hand, a distributor adapted to be put in communication with the high pressure and the low pressure and to supply said receiver ports, wherein said distributor is fixed and provided with a number of supply or transmitter ports which is equal to at least three but independent of the number of receiver ports, the transmitter ports being capable of being connected, by permutation in succession and in pairs, respectively to the low pressure and to the high pressure, the distance between the receiver ports and their lengths, on one hand, and the distance between the transmitter ports and their length, on the other hand, being such that by the step by step displacement in one direction of the drive element, on one hand, it is possible to bring each time at least one receiver port between the two transmitter ports of a pair, in such position that it communicates with neither one nor the other of these two transmittor ports but that any displacement in one direction or the other of the drive element puts at least one receiver port in communication respectively with one or the other of the two transmitter ports and, on the other hand, one of the transmitter ports of a following pair to be suppliied with fluid communicates with a receiver port.

In this known patent, the hydraulic communication ensuring the displacement of the drive element is constituted by a single manifold formed in the element carrying receiver ports or transmitter ports and into which manifold all the receiver ports supplied by the transmitter ports open.

An object of the present invention is also to provide a step-by-step servomechanism in which the maintenance in each set position is also achieved by a hydraulic locking, that is to say, by means of a suitable relative portion of fixed and moving parts, and in which the progression from one step to the other is also produced by permutation of hydraulic connections of certain of these ports, but in which the arrangement of the various elements differs from that described in the known patent and provides marked advantages from the point of view of performances and the point of view of simplicity of construction.

In the servomechanism according to the present invention, there is provided a drive element movable in a case which it divides into two chambers and provided with a plurality of receiver ports (receiver means) and supply or transmitter ports whose number is independent of the number of receiver ports and which transmitter ports are capable of being connected, by permutation in pairs and in succession, respectively with the low pressure and the high pressure, but the hydraulic communication ensuring the displacement of the drive element is here produced by plurality of manifold ports formed in the fixed body of the servomechanism and capable of communicating with the chamber of the drive element, all of the receiver ports being capable of being brought in succession into a position in which they open into one of said manifold ports.

The servomechanism according to the invention is therefore of the type comprising, on one hand, a drive element movable in a case, which it divides into two chambers, and provided with a plurality of receiver ports (receiver means) and, on the other hand, a fixed distributor adapted to be connected to the high pressure and the low pressure and to supply said receiver ports and having a number of supply or transmitter ports which is independent of the number of receiver ports, the transmitter being capable of being connected, in pairs, respectively to the low pressure and to the high pressure, wherein there are also provided a fixed manifold having a plurality of manifold ports capable of communicating with the chamber of the drive element, all the receiver ports being capable of being made to open in succession into one of said manifold ports, selecting means capable of connecting, in succession by permutation and simultaneously, at least one pair of transmitter ports to the high pressure and to the low pressure, respectively, and at least one manifold port to the chamber of the drive element, the distances between transmitter ports and their lengths, of the first part, the distances between receiver ports and their lengths, of the second part, and the distances between manifold ports and their lengths, of the third part, being such that by a step-by-step displacement in the one direction of the drive element, on one hand, it is possible to bring each time said element to a position in which there is no communication between the transmitter ports of said pair, respectively connected to the high pressure and the low pressure, and said manifold port connected to the chamber of the drive element, but that any displacement in one direction or the other of the drive element ensures the communication of said manifold port with one or the other of said transmitter ports, and, on the other hand, that one of the transmitter ports of a following pair to be connected respectively to the high pressure and to the low pressure communicates with at least one of the following manifold ports to be connected to the chamber of the drive element.

The displacement of the drive elemet which was ensured in the known patent by the cooperation between transmitter ports and receiver ports can be ensured, in accordance with the present invention, by cooperation between transmitter, receiver and manifold ports, since the supply circuit of the chamber of the drive element is here necessarily by way of a transmitter port, a receiver port, and a manifold port.

Likewise, whereas in the known patent, the transmitter ports were connected to the high pressure and to the low pressure by a suitable selector, the manifold ports of the present invention can also be connected to the chamber of the drive element by a selector capable of connecting them thereto or isolating them therefrom.

Consequently, by means of the present invention, it is possible, by the increase in the number of possible combinations of association between the various ports, either to increase the number of steps of the mechanism or, for a given number of steps, to increase the size of the receiver and transmitter ports.

It is also possible by means of the invention, by the combined action of the selector of the transmitter ports and the selector of manifold ports, to simplify the technical realization of the selection function for a given actuating order.

It also permits supplying, in a simple manner from the same distributor, the two active chambers of the servomechanism when the latter has in fact two (for example, double-acting jack or a hydraulic rotary motor). It also permits the construction of servomechanism having several step sizes.

It will be understood that the servomechanism according to the invention fulfills, in the same way as that of the known patent, the conditions of hydraulic locking, continuity of flow and no short circuit defined in the known patent. These conditions, as in the known patent, impose relations between the widths of the various ports and between their relative distances. The principles of these conditions will be established in the course of the ensuing description with reference to the accompanying drawings, in which:

FIG. 1 shows diagrammatically a servomechanism according to the known patent.

Figure 1:
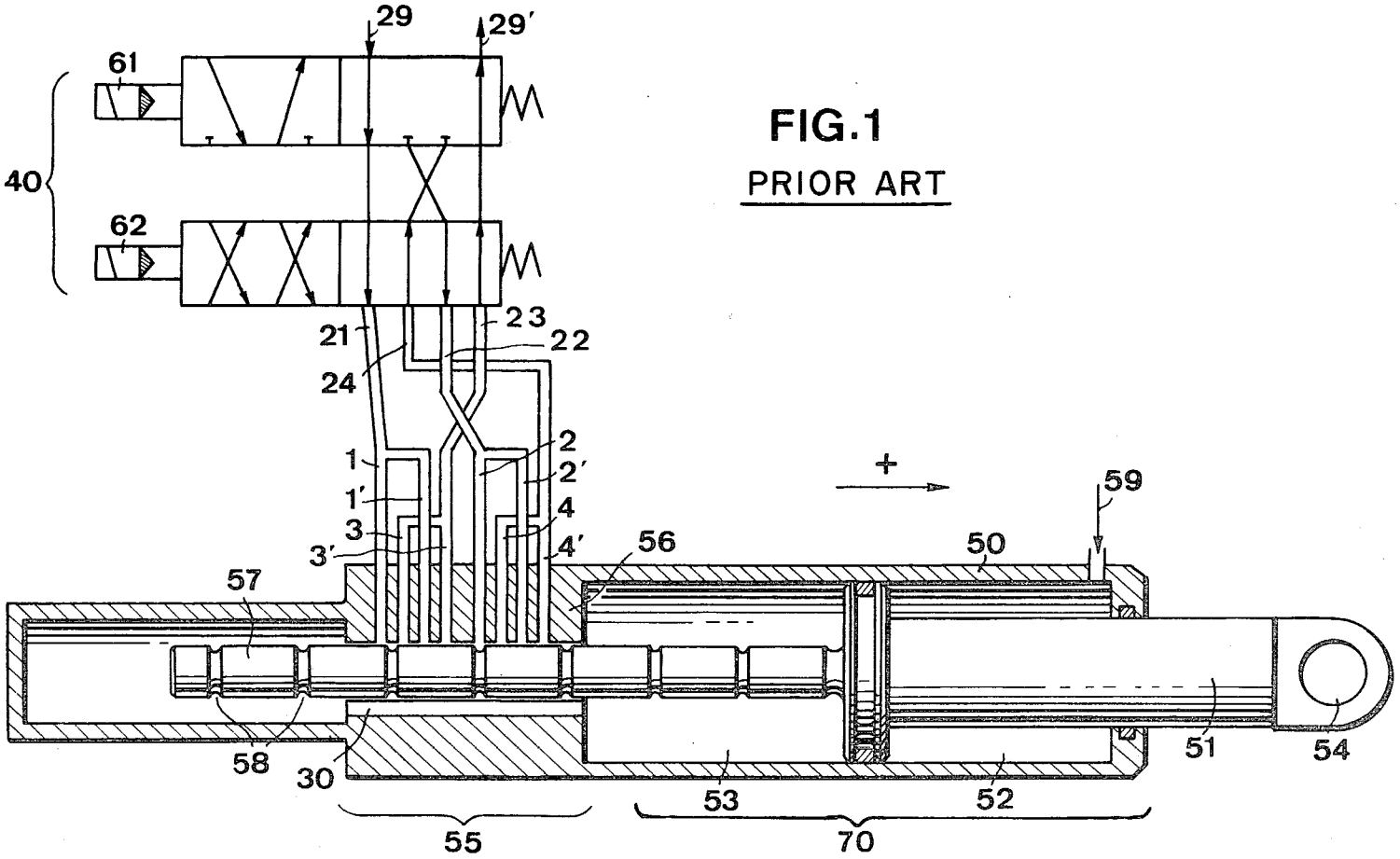
FIG. 1 PRIOR ART
FIG. 1 is the diagram of a servomechanism according to the known patent which is given to bring out the features common to the servomechanisms according to the invention and the differences between the two.

Movable in a fixed body 50 is a piston 51. The high pressure is constantly sent to the small chamber 52 by way of the conduit 59. The distributor 55 hydraulically locks the jack by the fact it re-establishes at each instant in the chamber 53 just the pressure necessary for balancing the exterior load applied on the movable fork 54.

For this purpose, the distributor 55 comprises the fixed transmitter 56 and the receiver 57 connected to the movable piston 51. The receiver 57 carries the receiver ports 58 which are here in the form of annular grooves. The transmitter 56 carries the transmitter ports 1, 1', 2, 2', 3, 3', 4 and 4' which are supplied, in pairs, by the transmitter conduits 21, 22, 23 and 24 respectively.

The transmitter 56 also carries the manifold groove 30, which could be replaced by a central longitudinal passage formed in the receiver 57, as shown in some figures of the known patent.

As mentioned in the known patent, with such an arrangement, the hydraulic locking of the active chamber 53 of the motor or drive element 70 is ensured by the fact that a transmitter port 1 subjected to the high pressure 29 opens onto the receiver 57, at a tangent to a receiver groove 58 and that a transmitter port 3 subjected to the low pressure 29' opens onto the receiver 57 at a tangent to the same receiver groove (as in the position shown in FIG. 1) or to another receiver groove, the orientation of the tangent points being such that a displacement of the movable drive element 57, or piston, establishes the suitable hydraulic communication for producing a movement of said piston in a direction opposed to the initial movement and therefore for correcting the disturbance.

In the ensuring description, the term edge will be employed, the edge of a port being the point (circular port) or the segment (rectangular port) of its perimeter by which this port comes in contact with another port with which it must cooperate.

In employing the terminology "edges", it will therefore be said that the locking is ensured by the coincidence of an edge of a transmitter port subjected to high pressure with the edge of a receiver groove and the coincidence of an edge of a transmitter port subjected to low pressure with another edge of the same, or another, receiver groove.

The edges of the transmitter ports become, in turn and in pairs, what might be termed "locking transmitter edges" each of which cooperates with a "locking receiver edge".

To lock an active chamber of the drive element therefore requires the cooperation of four locking edges associated in pairs; a right transmitter edge with a left receiver edge and a left transmitter edge with a right receiver edge, the terms right and left referring to edges which define a port respectively on the right and left.

The jack shown in FIG. 1 is a differential jack and there is only a single active chamber 53 to lock, but in the case of a double-acting jack or of a hydraulic rotary motor, there are two active chambers to lock and this requires the cooperation of eight locking edges.

To move the jack shown in FIG. 1, it is sufficient, by acting on the control solenoids 61 and 62 of the selector 40 connected to the high and low pressure sources 29 and 29', to switch the assignments of the transmitter conduits 21, 22, 23 and 24. The 16 edges of the 8 transmitter ports 1, 1', 2, 2', 3, 3', 4 and 4' will then become, in turn and in pairs, fixed locking edges in cooperating with two edges of the receiver grooves 58.

As the jack shown in FIG. 1 is controlled by two solenoids 61, 62 having two positions, the different successive control configurations are four in number. It will be said that the jack is quaternary, or that its control order $n = 4$. As each transmitter port (1, 2, 3, 4) is doubled or duplicated (1', 2', 3', 4'), a number $q = 2$ of pairs of fixed edges for each control configuration are assigned to the locking.

The following table I of progression gives the details of the successive permutations for advancing the jack, the succession of lines of the table corresponding each time to a displacement of one step $p$ of the jack in the positive direction.

This table also indicates the fixed locking edges which are effectively utilized in each position Each edge is referred to by the number of its port followed by the letter G or D, depending on whether it concerns the left edge or the right edge respectively of the port in the Figure.

TABLE I

| | Successive control configurations | | Assignments of the transmitter ports | | | | | |
|---|---|---|---|---|---|---|---|---|
| Successive states | 61 | 62 | 21 | 22 | 23 | 24 | Locking fixed edges employed | |
| I | O | O | P | X | R | X | 1D | 3G |
| II | ● | O | X | P | X | R | 2D | 4G |
| III | ● | ● | R | X | P | X | 3D | 1'G |
| IV | O | ● | X | R | X | P | 4D | 2'G |
| V | O | O | P | X | R | X | 1'D | 3'G |
| VI | ● | O | X | P | X | R | 2'D | 4'G |
| VII | ● | ● | R | X | P | X | 3'D | 1G |
| VIII | O | ● | X | R | X | P | 4'D | 2G |

TABLE I-continued

| Successive states | Successive control configurations 61 | 62 | Assignments of the transmitter ports 21 | 22 | 23 | 24 | Locking fixed edges employed | |
|---|---|---|---|---|---|---|---|---|
| IX ≡ I | O | O | P | X | R | X | 1D | 3G |

P = Connected to the high pressure source
R = Connected to the low pressure source (return)
X = Closed
O = Non-excited, = Excited The jack shown in FIG. 1 is depolarized (each transmitter conduit alternately assigned to the high pressure and to the low pressure) and simplex (in each control configuration a single one of the transmitter conduits 21, 22, 23, 24 receives the high pressure and a single one the low pressure).

The same locking fixed edges are employed every *nq* steps (here 8 steps). They must therefore have in front thereof, every *nq* steps, receiver edges disposed in an identical manner.

Whence the first constructional rule which is applicable both to the mechanism of the known patent and to that of the present invention. The minimal possible number of receiver ports is that which corresponds to an equal distribution at the step.

$$P = nqp \tag{1}$$

It is true that it is possible in certain cases, and mainly for increasing the flow of the distributor, to multiply the number of receiver ports, for example to multiply it by *q* or a sub-multiple of *q*.

This operation is usually possible with the servomechanism of the known patent and it is sometimes possible with the servomechanism according to the present invention, but it presents no theoretical necessity.

Figure 2:
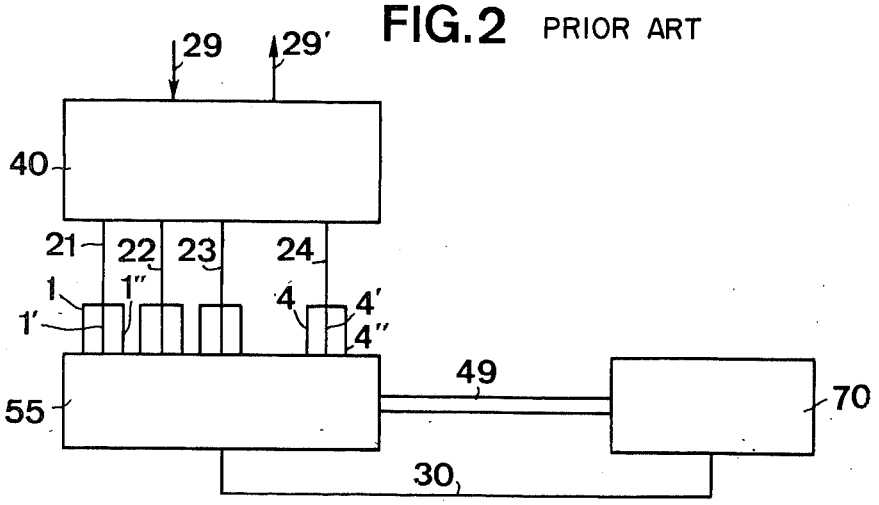
FIG.2 PRIOR ART
FIG. 2 is a general operational diagram of the servomechanism according to the known patent.

FIG. 2 gives the general operational diagram of the servomechanisms according to the known patent, such as that shown in FIG. 1.

70 is the motor or drive element, 55 is the distributor, 40 is the selector upstream of the distributor, 21, 22, 23, 24 etc. . . are the transmitter conduits, 1, 1′, 1″ etc. . 2,2′,2″ etc. . are the transmitter ports, with 1, 1′, 1″ etc. . being connected to the conduit 21, with 2, 2′, 2″ etc. . being connected to the conduit 22 etc. ., 30 is the single manifold connecting the distributor 55 to the active chamber of the drive element 70, 49 is the connection which supplies the distributor with the information concerning the position of the drive element. It may be said that 49 is the symbol of the mechanical connection between the receiver 57 and the piston 51 shown in FIG. 1.

Figure 3:
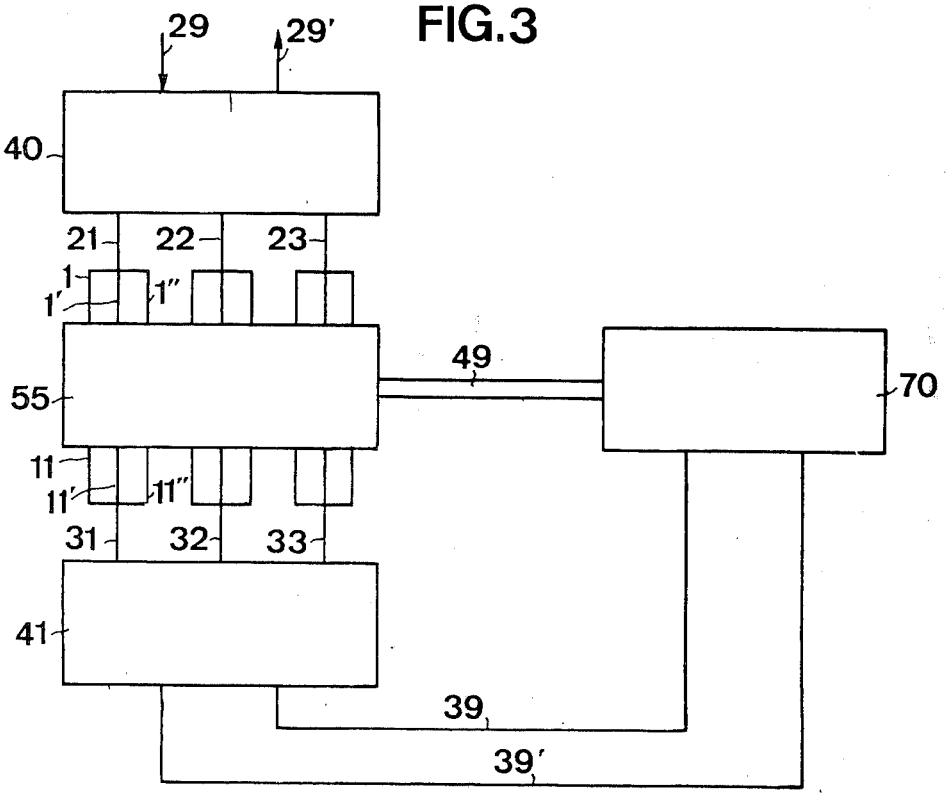
FIG. 3 is a general operational diagram of the servomechanism according to the invention.

FIG. 3 shows the general operational diagram of the servomechanism according to the present invention.

This diagram shows the motor or drive element 70, the distributor 55, the upstream selector 40, the transmitter conduits 21, 22, 23, etc. ., the several series of transmitter ports 1, 1′, 1″ etc. ., and the connection 49. The upstream selector, transmitter conduits and transmitter ports all constitute an upstream distributor means.

But the single manifold 30 is replaced by the following means: a plurality of series of manifold ports 11, 11′, 11″ etc. ., respectively connected to the manifold conduits 31, 32 etc. . a downstream selector 41, a manifold 39 connecting the downstream selector 41 to the active chamber of the drive element 70, possibly another manifold 39′ supplying a second active chamber of the drive element since, as will be seen hereinafter, the principle of the present invention permits supplying a plurality of active chambers from the same distributor. The manifold ports, manifold conduits, downstream selector and manifolds all constitute a downstream distributor means.

Figure 4:
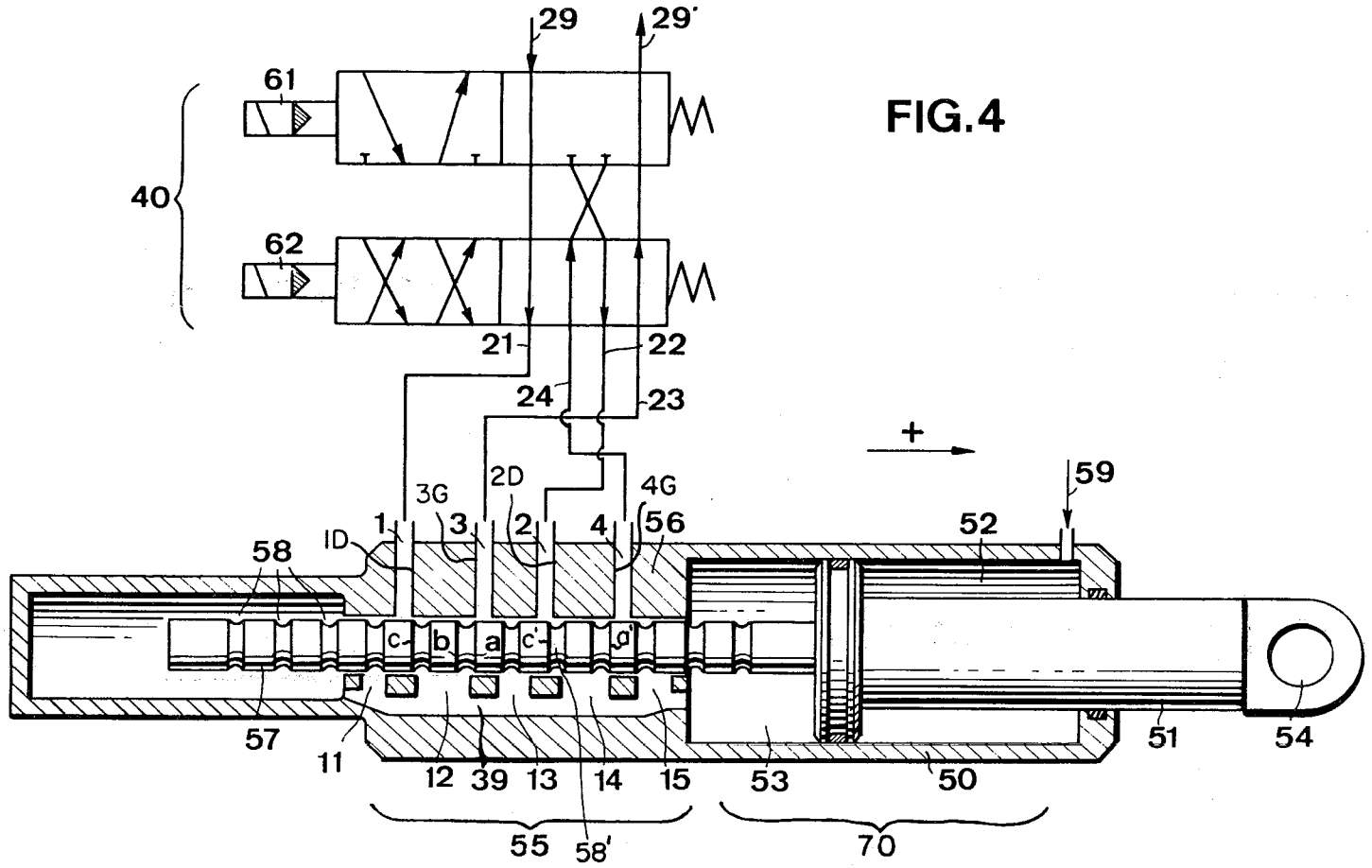
FIG. 4 is a diagram of a first embodiment of a servomechanism according to the invention.

FIG. 4 shows a servomechanism according to the present invention.

It concerns a simplex, depolarized quaternary ($n = 4$) differential jack which has four transmitter ports 1, 2, 3, 4 defining 8 locking fixed transmitter edges and manifold ports 11, 12, 13, 14, 15 defining 8 locking manifold edges 11D, 12D, 13D, 13G, 14D, 14G, and 15G, with each edge always being denoted by the number of its port followed by the letter D or G, depending on whether it concerns the right or left edge respectively in the Figure.

This jack has no downstream selector 41.

It functions in an identical manner to the jack of the known patent whose diagram is given in FIG. 1. Its system of selection is also identical. The detail of its operation is described by the following progression table II which has been established with the same conventions as the progression table I of the jack shown in FIG. 1.

TABLE II

| Successive states | Successive control configurations 61 | 62 | Assignments of the transmitter conduits 21 | 22 | 23 | 24 | Locking fixed edges employed | |
|---|---|---|---|---|---|---|---|---|
| I | O | O | P | X | R | X | 1D | 3G |
| II | ● | O | X | P | X | R | 2D | 4G |
| III | ● | ● | R | X | P | X | 12D | 1G |
| IV | O | ● | X | R | X | P | 14D | 2G |
| V | O | O | P | X | R | X | 11D | 13G |
| VI | ● | O | X | P | X | R | 13D | 15G |
| VII | ● | ● | R | X | P | X | 3D | 12G |
| VIII | O | ● | X | R | X | P | 4D | 14G |
| IX | O | O | P | X | R | X | 1D | 3G |

Referring to Table II and FIG. 4, drive element 57 is shown in State I of the table. High pressure is applied through port 1 and low pressure through port 3 to hydraulically lock drive element 57 with the right edge 1D of port 1 being aligned with the left edge *c* of one receiver port and the left edge 3G of port 3 being aligned with the right edge *a* of an adjacent receiver port 58. Thus, the pressure in ports 1 and 3 are effectively cut off from reaching chamber 53 by edges *a* and *c*, but communication between these ports and chamber 53 will be established through manifold port 12 if drive element 57 is subjected to an external displacement in one direction or the other. This pressure will resist the external displacement and tend to return drive element 57 to its initial position.

Referring now to State II of Table II, a one step displacement of drive element 57 in a positive direction will be effected by applying high pressure through port 2 and low pressure through port 4. High pressure will flow from port 2, through receiver port 58′, through manifold port 14 to chamber 53 to move drive element 57 against the force of fluid in chamber 52. This movement will continue until the pressure in port 2 is cut off when the left edge $c'$ of port 58' becomes aligned with right edge 2D of port 2. At that time, right edge $a'$ of an adjacent receiver port 58 will also become aligned with left edge 4G of port 4 to reestablish hydraulic locking of drive element 57. The remaining States in Table II are reached in a similar fashion. However, since the edges of manifold ports 11–15 are not aligned with the edges of ports 1–4, the aformentioned edges are available to lock drive element 57 as in States III–VIII of Table II. Although apparent gaps are illustrated between the lands of drive element 57 and its surrounding structure, this representation is schematic for the sake of clarity only. In actuality, no gaps exist between the lands of drive element 57 and its surrounding structure, the drive element 57 capable of sliding movement while preventing flow of fluid across the lands.

There will now be established the second condition, which is optimal or essential in certain cases, imposed on the jack according to the invention.

Let us consider the servomechanism locked hydraulically, in succession in the two positions of its receiver 57, and therefore of its movable piston 51, of abscissae $j$ and $j + np$. These two positions correspond to the same control configuration and are therefore characterized by the identity of the assignment of all the conduits, even if the locking edges effectively employed are not the same for the two positions.

It has been stated that the fact of moving the servomechanism away from its locking position established the appropriate hydraulic communication to return it to its initial condition, that is to say, the communication between the active chamber 53 and the high pressure source for one direction of displacement and the communication between the active chamber and the low pressure source for the other direction.

Therefore, displacing to the position $j + np$ the servomechanism which was initially locked in position $j$ or displacing it to the position $j$ when it was initially locked in position $j + np$, establishes different communications and the coexistence of these two communications for an intermediate position between $j$ and $j + np$ would produce a short-circuit.

If the paths in which these communications are maintained are termed respectively $\epsilon$ and $\epsilon'$, the condition of no short circuit is expressed:

$$\epsilon + \epsilon' \leqslant np$$

But it is clear that in order to facilitate the supply of the jack, the paths $\epsilon$ and $\epsilon'$ would be desired to be as large as possible. Moreover, in a general way there is no major reason to complicate the drawing by making $\epsilon$ and $\epsilon'$ different. Therefore the following condition may be considered to be a condition of optimisation of the jack:

$$\epsilon = \frac{np}{2} \tag{2}$$

Moreover, in the case of the depolarized jack such as that shown in FIG. 1, which is of particular interest since it permits a reduction in the number of conduits, each transmitter conduit is assigned in succession to one source of pressure and to the other source of pressure, every $(n/2)$ steps. The locking edge establishing the communication $\epsilon$, and the closing edge which thereafter cuts it off exchange their functions: thus it can be seen that for a depolarized jack, the condition $$\epsilon = \frac{np}{2}$$

becomes an essential condition.

In the case of the jack shown in FIG. 1, as for all those of the known patent, the communication between the active chamber 53 and the source of pressure 29 or 29', results from the passage of a receiver port 58 of length $r$ in front of a transmitter port (1, 2, 3, 4, 1', 2', 3', 4') of length $e$. This communication is therefore maintained in a path $\epsilon = e + r$.

The condition (2) is then expressed:

$$e + r = \frac{np}{2} \tag{3}$$

$$\left[\text{In FIG. 1} : e = r = \frac{np}{4} = p\right]$$

It will now be shown how the mere fact of replacing 16 fixed transmitter edges for locking the jack shown in FIG. 1 by 8 transmitter fixed edges and 8 manifold fixed edges, permits considerably increasing length of the ports by the same step size.

(In FIG. 4, the steps are one half of those of FIG. 1 and the transmitter ports are however 1.5 times longer).

Let us consider for this, for example, the 4 fixed edges 3G, 3D, 12D, 13G and the 2 moving edges $a$ and $b$ (FIG. 4).

Let us term respectively $x_{3G}$, $x_{3D}$, $x_{12D}$, $x_{13G}$, $x_a$ and $x_b$ their abscissae in the position shown in the diagram and let us imagine a displacement of the piston in the positive direction. Let us place the origin at $x_{3G}$ ($x_{3G} = 0$).

From the previously developed considerations, the following table of events results:

TABLE II'

| Position of receiver | Event | Participating edges | Resulting geometric relation | |
|---|---|---|---|---|
| 0 | Establishment of the communication | 3G and a | $X_{3G} = O$ | |
| $\frac{np}{2}$ | Cut off | 12D and b | $x_{12D} = x_b + \frac{np}{2}$ | (4) |
| np | Re-establishment | 13G and a | $x_{13G} = +\,np$ | (5) |
| $\frac{3np}{2}$ | cut off | 3D and b | $x_{3D} = x_b + \frac{3np}{2}$ | (6) |

$$\text{By definition} \begin{cases} r = -x_b \\ e = x_{3D} \\ \text{(6) is therefore written } e + r = \frac{3np}{2} \end{cases} \tag{7}$$

The fact of replacing the passage of a receiver port of length $r$ in front of a transmitter port of length $e$ by the passage of a receiver port of length $r$ between a transmitter port of length $e$ and two manifold ports, permits replacing the law (3) $e + r = (np/2)$ by the law (7) $e + r = (3np/2)$, and therefore tripling the length of the transmitter and receiver ports for the same step size.

This result is easily generalized.

In the case of FIG. 4, a group of four fixed edges had to establish the communications concerning a transmitter conduit, namely on a primary cycle $P = nqp = 2np$ : a communication of length $\frac{1}{2}\,np$, then a closure of the same length, then another communication, then another closure, of the same lengths.

But if, instead of assigning a single group of 4 edges to this function, $g$ groups of 4 edges are assigned thereto, the primary cycle will become $P = 2gnp$ and the $g$ groups of edges can be employed alternately.

For example, the first will open the communication with one of its opening edges at $x = 0$ (closing it at $x = \frac{1}{2}$ np), the second will open the communication at $x = np$, the third at $x = 2\ np$, the gth $x = (g - 1)\ np$, the first only re-intervening with its other opening edge at $x = gnp$ and closing at $x = (g + 1/2)\ np$.

Under these conditions, (5) becomes: $x_{13G} = gnp$ (5')

and (6) becomes: $x_{3D} = x_b + (g + \frac{1}{2})\ np$ (6')

$$\text{whence}: e + r = (g + \tfrac{1}{2})np = \frac{q+1}{2})np \qquad (10)$$

since $q = 2g$.

In certain cases it may be of interest to have a number of pairs of useful edges $q$ assigned to each odd transmitter conduit. There will then be $g$ groups of 4 edges and one group of 2 edges and the smallest gap between two opening positions pertaining to the same group of 4 edges cannot exceed gnp.

The equations (5') and (6') are retained but $q$ is worth here $2g + 1$ and therefore $g$ is worth $(q - 1/2)$ $$\text{Whence}: e + r = \frac{q}{2}\ np \qquad (10')$$

The relations (3), (10) and (10') can be reduced to a single relation:

$$e + r = [(\text{whole part of } \frac{q}{2}) + \tfrac{1}{2}]np \qquad (11)$$

An example will be given in the embodiment shown in FIG. 9.

Table II' can moreover give us further information which will be sufficient to design the distributor of a servomechanism according to the present invention.

$$\text{Let } f = x_{13G} - x_{12D}$$

$f$ will therefore be the length of the land which separates the 2 manifold ports 12 and 13.

$$\text{Also let } d = x_{3D} - x_{13G} = -x_{13G}$$

$d$ will therefore be the algebraic value of the opening between the transmitter port 3 and the manifold port 13, which opening is moreover negative in the case of the Figure.

In subtracting (4) from (5'), there is obtained:

$$X_{13G} - X_{12D} = -X_b + (2g - 1)\frac{np}{2}, \qquad (8)$$

$$\text{namely } f = r + (2g - 1)\frac{np}{2}$$

By subtracting (5') from (6'), there is obtained:

$$x_{3D} - x_{13G} = x_b + \frac{np}{2} \qquad (9)$$

$$\text{namely } d + r = \frac{np}{2}$$

It is in fact this relation which must be brought closer to the relation (3): the length of the transmitter port which appeared in this relation (3) is to be replaced by the opening $d$.

The above relations define the relative positions of the edges. The whole distributor may be considered as a construction of a certain number of "groups" of 4 edges (+ possibly $n$ groups of 2 edges).

For example, to design the distributor shown in FIG. 4, it is sufficient to reproduce the design of the four edges 3G, 3D, 12D, 13G at successive relative distances of $$(4k + l)\ p,$$

The choice of $k$ (whole number) resulting from technical considerations and also fro the desire to make as far as possible an economy of the edges which are not used for the locking.

In the diagram shown in FIG. 4, $n = 4$ and $q = 2$ imposed $e + r = (3 \times 4/2)\ p = 6\ p$, the choice was $e = r = 3p$.

The 8 transmitter edges are locking edges. Of the 10 manifold edges, only the edges 11G and 15D (shown in dotted line in FIG. 4) remain unused for the locking.

Figure 5:
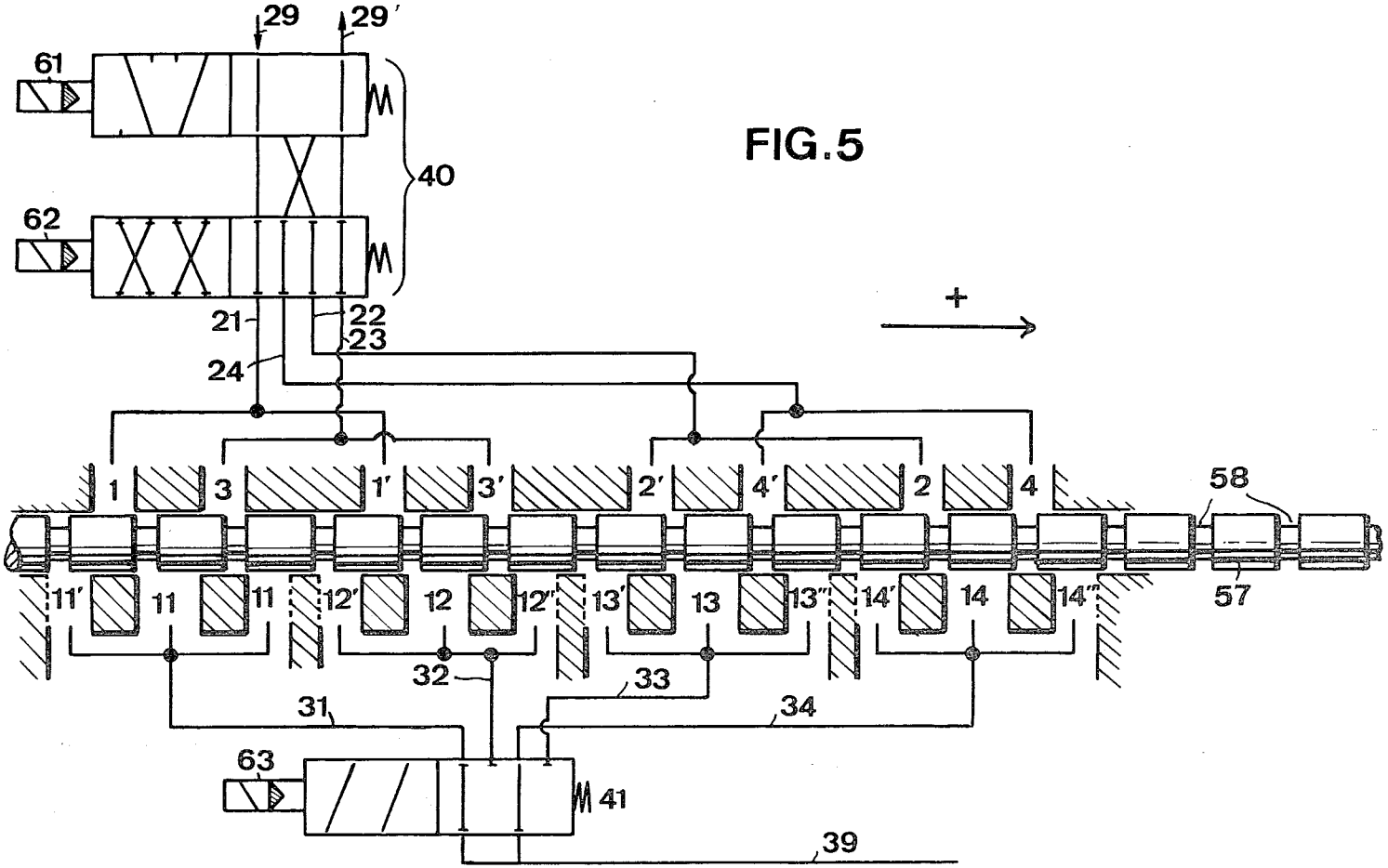
FIGS. 5 to 9 are diagrams of different other embodiments of servomechanisms according to the invention.

FIG. 5 shows, by its distribution diagram, another servomechanism according to the invention.

It concerns a simplex, depolarized octary ($n = 8$), differential jack.

It has 16 transmitter edges and 16 manifold edges for locking, and an upstream selector 40 and and downstream selector 41.

As the communications between the active chamber and each one of the sources of pressure is in this jack, as in the jack shown in FIG. 4, established by the passage of the receiver ports between transmitter ports 1, 1', 2, 2', 3, 3', 4, 4') and manifold ports (11, 11', 11'', 12, 12', 12'' . .), the law (7)

$$e + r = \frac{3np}{2}$$

is also applicable here.

Since $n = 8$, $e + r = 12p$.

There has been chosen: $r = 4p$ and $e = 8p$.

There is therefore taken from the law (9), $$d + r = \frac{np}{2} = 4p,$$

$d = 0$. The manifold and transmitter locking edges are therefore, in this case, coplanar two by two, which permits, for example, the construction of the distributor by stacking washers.

The following progression table, established with the same conventions as the tables relating to the preceding figures, describes the detail of operation.

TABLE III

| Successive states | Successive control configurations 61 | 62 | 63 | Assignments of the transmitter conduits 21 | 22 | 23 | 24 | Assignments of the manifold conduits (O=open) 31.34 | 32.33 | Locking fixed edges employed | |
|---|---|---|---|---|---|---|---|---|---|---|---|
| I | O | O | O | P | X | R | X | O | X | 11"G | 1D |
| II | O | O | ⊘ | P | X | R | X | X | O | 12"G | 1'D |
| III | ⊘ | O | ● | X | P | X | R | X | O | 13"G | 2'D |
| IV | ● | O | O | X | P | X | R | O | X | 14"G | 2D |
| V | ● | ⊘ | O | R | X | P | X | O | X | 1G | 3D |
| VI | ⊘ | ● | ● | R | X | P | X | X | O | 1'G | 3'D |
| VII | O | ● | ● | X | R | X | P | X | O | 2'G | 4'D |
| VIII | O | ● | O | X | R | X | P | O | X | 2G | 4D |
| IX | O | O | O | P | X | R | X | O | X | 3G | 11'D |
| X | O | O | ● | P | X | R | X | X | O | 3'G | 12'D |
| XI | ● | O | ● | X | P | X | R | X | O | 4'G | 13'D |
| XII | ● | O | O | X | P | X | R | O | X | 4G | 14'D |
| XIII | ● | ● | O | R | X | P | X | O | X | 11G | 11D |
| XIV | ● | ● | ● | R | X | P | X | X | O | 12G | 12D |
| XV | O | ● | ● | X | R | X | P | X | O | 13G | 13D |
| XVI | O | ● | O | X | R | X | P | O | X | 14G | 14D |
| XVII=I | O | O | O | P | X | R | X | O | X | 11"G | 1D |

It will be observed that all the 16 transmitter edges are locking edges and only the 24 manifold edges are not locking edges 11'G, 11"D, 12'G, 12"D, 13'G, 13"D, 14'G, 14"D (shown in dotted line in FIG. 5).

Figure 6:
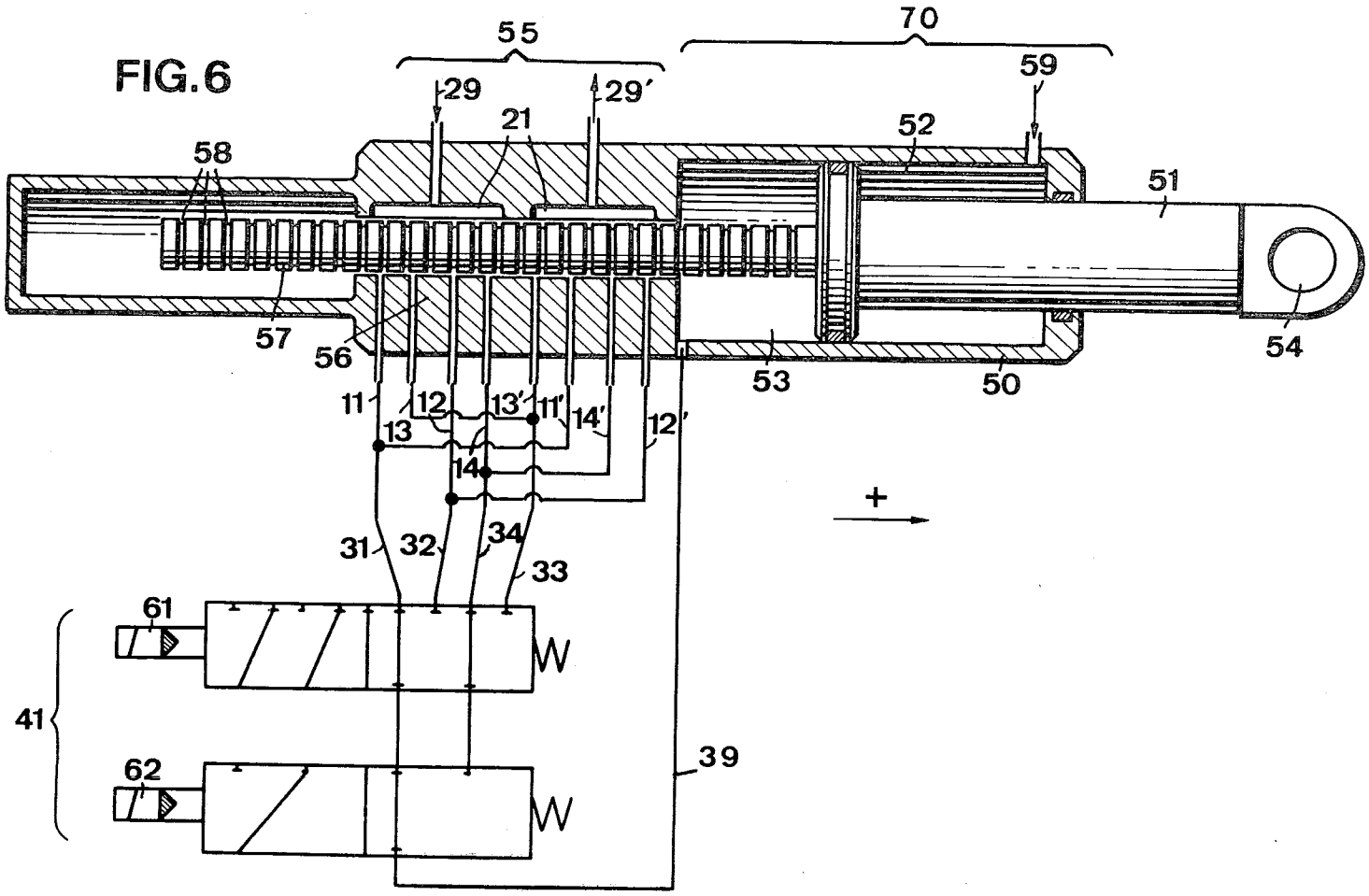

FIG. 6 shows diagrammatically a simplex, polarized, control order $n = 4$, differential jack. It is characterized by the absence of locking transmitter edges (the sole locking fixed edges being the manifold edges) and by the absence of an upstream selector 40 (the selection being solely effected by the downstream selector 41).

The interest of this jack, which has exactly the same function as the reference jack shown in FIG. 1 and which, as the last-mentioned jack, must satisfy the law (3): $e + r = (np/2)$, resides in the simplicity of the selector. (A distributor 62 having three ports and a distributor 61 having six ports instead of a distributor having six ports and a distributor having eight ports).

The progression table is as follows:

| Successive states | Successive control configuration 61 | 62 | Assignments of the manifold conduits 21 | 22 | 23 | 24 | Locking fixed edges employed | |
|---|---|---|---|---|---|---|---|---|
| I | O | O | O | X | X | X | 11D | 11'G |
| II | ● | O | X | O | X | X | 12D | 12'G |
| III | ● | ● | X | X | O | X | 13D | 13'G |
| IV | O | ● | X | X | X | O | 14D | 14'G |
| V | O | O | O | X | X | X | 11D | 11'G |

Figure 7:
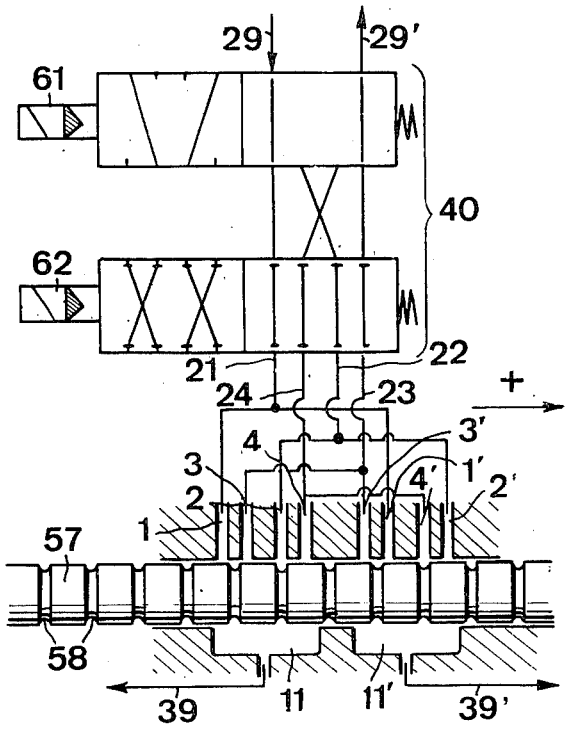

FIG. 7 shows, by its distribution diagram, a simplex, depolarized, quaternary ($n = 4$), double-acting jack.

It has no locking manifold edges and no downstream selector 41. But the existence of two manifold ports 39 and 39' and the doubling or duplication of the transmitter ports (1, 1', 2, 2', 3, 3', 4 and 4') permits supplying the two active chambers of the jack in a simple manner.

The fact that, in order to displace the jack in one direction it is necessary to supply one of its chambers and empty the other, obviously leads to a different relative disposition of the sets of ports assigned to each chamber.

The order 1, 3, 2, 4 will be noted here from left to right for the left chamber and the order 3', 1', 4', 2' for the right chamber.

Figure 8:
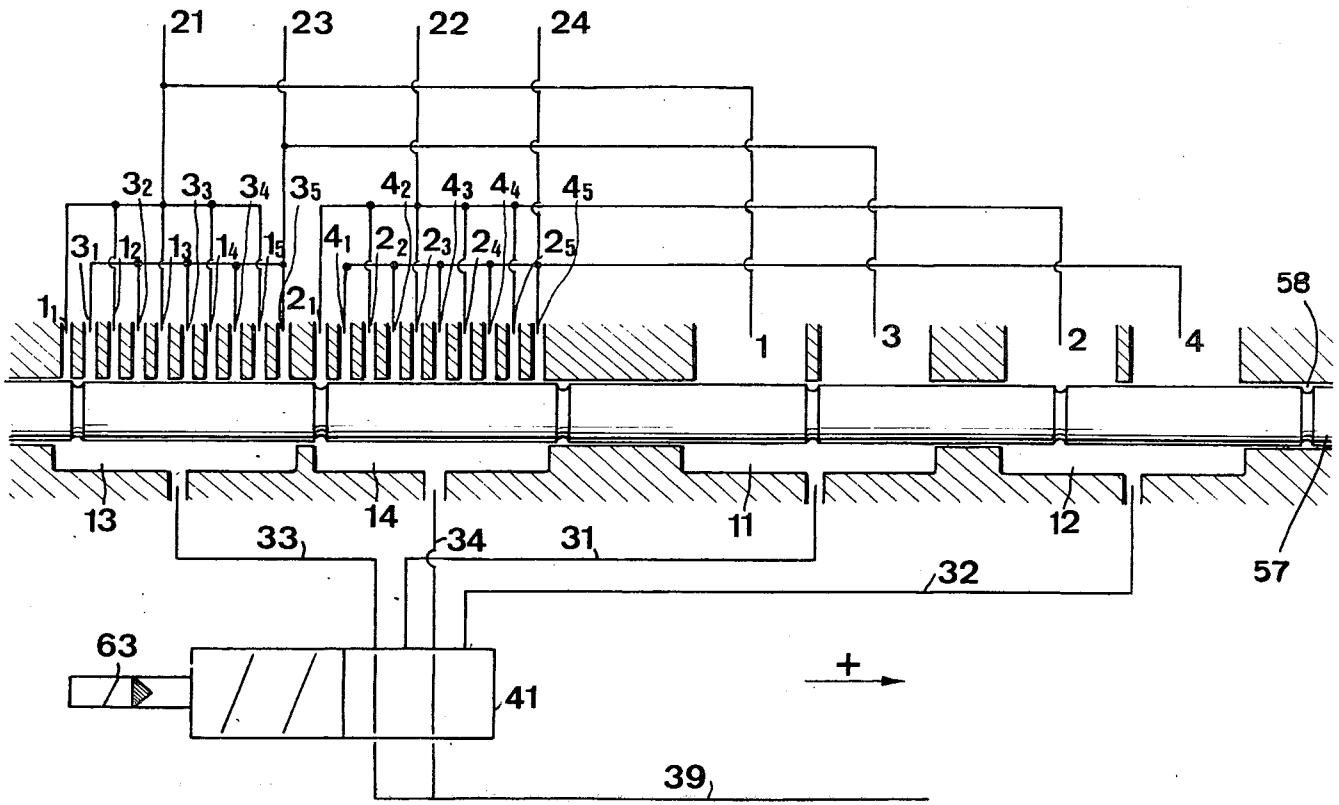

FIG. 8 shows, by its distribution diagram, a jack having two step sizes. It concerns a simplex, depolarized, differential jack having a control order $n = 4$.

The upstream selector 40 (not shown but identical to the upstream selectors 40 shown in FIGS. 1, 4, 5 and 7) is employed for advancing the jack.

The downstream selector 41 is employed for the choice of the size of the steps.

The distributor comprises two transmitter-manifold assemblies, each of which is assigned to one step size, the assemblies being supplied in parallel by the upstream selector 40 and cooperating with the same receiver ports 58.

The transmitter-manifold assembly assigned to the small steps and shown on the left in the diagram, comprises, on one hand, 20 transmitter ports, namely 4 series of 5 ports $1_1, 1_2, 1_3, 1_4, 1_5 2_1 2_2 \ldots 4_5$ connected in parallel respectively to each one of the 4 transmitter conduits 21, 22, 23, and 24, the 5 ports of one series being disposed at the step $4p$ and, on the other hand, 2 manifold ports, the port 13 cooperating with the five pairs $1_1, 3_1, 1_2, 3_2, \ldots 1_5, 3_5$, and the port 14 cooperating with the 5 pairs $2_1, 4_1, \ldots 2_5, 4_5$.

The length of the small transmitter ports $e'$ and the length of the receiver ports $r$ are related by the law (3)

$$e' + r = \frac{np}{2}$$

Here the choice is $e' = r = p$.

As each transmitter port is quintupled, the minimal step of the receiver ports is $$p = nqp = 4.5.\ p = 20p$$

It is this step which has been chosen.

The transmitter-manifold assigned allotted to the large steps, here having a length $G = 5p$, on the right side of the diagram, comprises 4 single transmitter ports 1, 2, 3, 4 supplied in parallel with the transmitter ports assigned to the small steps and respectively, by the transmitter conduits 21, 22, 23 and 24 and 2 manifold parts, the port 11 being assigned to the transmitter pair 1, 3 and the port 12 assigned to the transmitter pair 2, 4.

The length of the transmitter ports $e$ and the length of the receiver ports $r$ are related by the relation (3)

$$e + r = \frac{nG}{2} = \frac{5np}{2} = 10p$$

as $r$ has already been chosen and equals $p$, $e = 9p$.

As, in the illustrated configuration, the manifold conduits 33 and 34, respectively connected to the manifold ports 13 and 14, open onto the active chamber of the drive element by way of the selector 41 and the piping 39, the jack operates in the "small step" mode.

In order to change to the "large step" mode, it is sufficent to switch 41, that is to say, to open 31 and 32 to 39 and at the same time close and isolate from each other 33 and 34. The isolation from each other of the two unused manifold conduits is essential. If this isolation is not effected there would be cases of short circuit between the two sources of pressure.

The choice of a step size ratio of 5 for a jack having a controlled order $n = 4$ is not accidental. Indeed, any outlet position capable of being assumed by the jack in the "large step" mode is expressed $$X = G\,(4k + J) \qquad (10)$$

in which G is the length of the large step, $k$ is a whole number, J is a whole number equal to 0, 1, 2, or 3 and which is the order number of the control configuration required for reaching the position X.

With $G = 5p$ the relation (9) is written: $X = 5p\,(4k + J) = p\,(20k + 5J) = p\,[(20k + 4J) + J]$ As $(20k = 4J)$ is a multiple of 4 it can be written $4k'$, whence $$X = p\,(4k' + J)$$

Consequently, irrespective of the position reached by the jack operating in the "large step" mode, it may be switched with no risk of disturbance, since this position still corresponds to the same control configuration in the "small step" mode.

The same result is obtained for a jack having a control order $n$ with a "large step" to "small step" ratio equal to $kn + 1$.

Obviously, this result cannot be reversible. In order to effect the reverse switching with no risk of disturbance it would be necessary to effect it after a total displacement in the "small step" mode equal to zero or to a multiple of $5p$.

It is obviously possible to cumulate in the same jack the presence of a system permitting the realization of two step sizes and the presence of locking manifold edges, which would be of particular interest in respect of the smallest step size in respect of which one tries to avoid excessively small ports.

Figure 9:
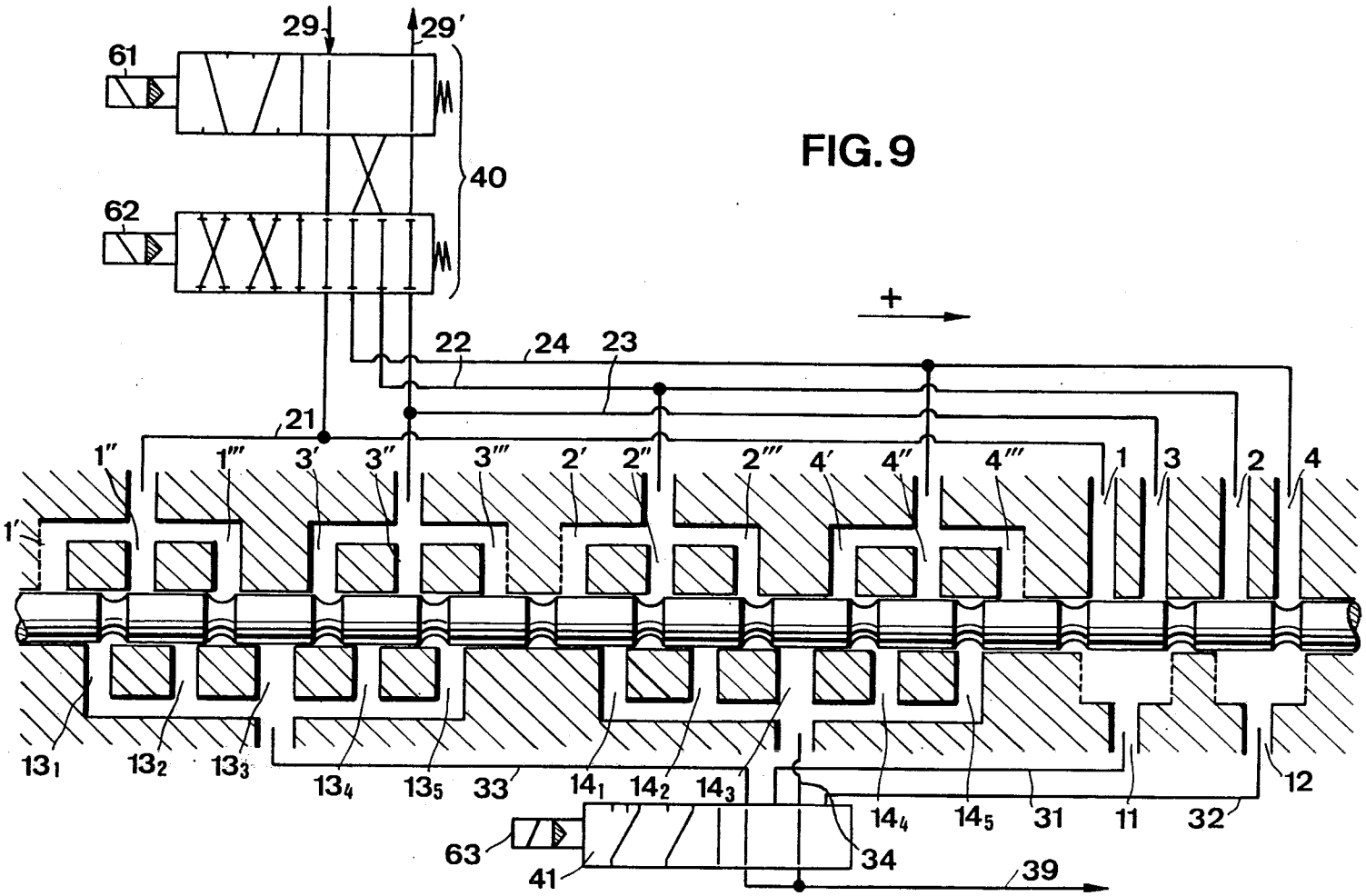

This has been achieved in the diagram shown in FIG. 9, which is that of a simplex, depolarized differential jack having a control order $n = 4$ and two step sizes ($G = 5p$) and locking manifold edges in a transmitter-manifold assembly assigned to the small steps.

The receiver grooves have a length $r = 5p$ and are disposed for a step $P = 20p$.

In the part of the distributor concerning the small steps $q = 5$, $e = 5p$ and therefore $e + r = 10p$ and (whole part of $(q/2) = 2$.

The relations (1) $P = n\,q\,p$ and (11) $(e + r) = [(\text{whole part of } (q/2) + 1/2]\ np$ are satisfied.

In the part concerning the large steps $G = 5p$:

$$q = 1,\ e = 5p$$

therefore $e + r = 10p = 2\,G$ and (whole part of $(q/2) = 0$.

The relations (1) (11) are also satisfied.

What I claim is:

1. A step-by-step controlled servomechanism of the type comprising, a driving element (51, 57) movable in a case (50) which it divides into two chambers (52, 53) and provided with a plurality of receiver ports (58), a high pressure supply (59) continuously applied to one of said chambers (52), a high pressure source (29) and a low pressure source (29'), and, an upstream distributor means (40, 56) adapted to be connected to said high pressure source (29) and to said low pressure source (29') and to supply said receiver ports (58) and having a number of transmitter ports (1, 2, 3, 4) which are independent of the number of receiver ports (58), said transmitter ports (1, 2, 3, 4) being capable of being connected, in pairs, respectively to said low pressure source (29') and to said high pressure source (29), a downstream distributor means (39, 41) having a plurality of manifold ports (11, 12, 13 . . . ) capable of communicating with the other of said chambers (53), all of said receiver ports (58) being capable of being made to open in succession into one of said manifold ports (11, 12, 13 . . .), said upstream distributor means (40) including selecting means (61, 62) capable of effecting the connection, in succession by permutation and simultaneously, at least one pair (1, 3) of transmitter ports to said high pressure source (29) and to said low pressure source (29'), respectively, said downstream distributor means (39, 41) being capable of effecting the connection of at least one manifold (port (11, 12, . . .) to said other chamber (53), the distances between said transmitter ports (1, 2, 3, 4) and their lengths, firstly, the distances between said receiver ports (58) and their lengths, secondly and the distances between said manifold ports (11, 12, 13 . . .) and their lengths, thirdly, being such that, by a step-by-step displacement in one direction of said drive element (51, 57) it is possible to bring each time said element to a position in which there is no communication between said transmitter ports (1, 3) of said pair, respectively connected to said high pressure source (29) and to said low pressure source (29'), and said manifold port (12) connected to said other chamber (53), but that any displacement in one direction or the other of said drive element (51, 57) ensures the communication of said manifold port (12) with one or the other of said transmitter ports (1,3) to resist an external force on said drive elements (51, 57), and, that one of the ports of a following pair of transmitter ports (2, 4) to be connected respectively to said high pressure source (29) and to said low pressure source (29') communicates with at least one of the following manifold ports to be connected to said other chamber (53).

2. A servomechanism as claimed in claim 1, wherein with the receiver ports having a length $r$, the transmitter ports a length $e$, the successive control configurations being in the number of $n$ and each time corresponding to a displacement of one step $p$ of the drive element and the ports pairs assigned to the locking for each control configuration being in the number of $q$, there exists between these magnitudes the following relation.

$e + r =$ [(whole part of $(q/2)+(1/2]$ $np$ and the minimal step of the receiver ports is $P = n\,q\,p$.

3. A servomechanism as claimed in claim 2, wherein the distributor comprises two transmitter-manifold assemblies in respect of which assemblies the numbers of $q$ of pairs of ports assigned to the locking for each control configuration are different and therefore correspond to two sizes of step $p$ of the drive element.

4. Step-by-step controlled servomechanism adapted to resist an external force comprising:

(a) a housing (50);

(b) a drive element (51,57) movable in said housing (50) in first and second opposed directions, said drive element (51,57) dividing said housing (50) into two chambers (52,53), said drive element (51,57) being provided with a plurality of spaced receiver ports (58);

(c) a high pressure supply (59) continuously applied to one of said chambers (52);

(d) a high pressure source (29) and a low pressure source (29');

(e) a distributor means (40) for providing selective communication between said high pressure (29) and low pressure (29') sources and said receiver ports (58), said distributor means (40) including a number of spaced transmitter ports (1,2,3,4) in said housing (50) adapted to communicate with said receiver ports (58), said distributor means (40) further including means (61,62) for connecting said transmitter ports (1,2,3,4) by permutation, in succession and in pairs, respectively, to said low pressure source (29') and to said high pressure source (29);

(f) a manifold means (39) for connecting said receiver ports (58) to the other one (53) of said chambers, said manifold means including a plurality of spaced manifold ports (11,12,13. . . ) located in said housing (50);

(g) said transmitter ports (1,2,3,4) and said manifold ports (11,12,13. . .) being located relative to one another to define a plurality of longitudinally spaced locking edges;

(h) a pair of transmitter ports (1,3) being respectively coupled by said connecting means (61,62) to said high (29) and low (29') pressure sources, at least some of said receiver ports (58) being located adjacent a pair of said locking edges (1D, 3G) such that neither one nor the other of said pair of transmitter ports (1,3) communicate with said other chamber (53), but where a displacement in said first or second directions of said drive element (51,57) due to said external force thereon puts one or the other of said pair of transmitter ports (1,3) in communication with said other chamber (53) to resist the external force thereby effecting a hydraulic locking of said drive element (51,57); and (i) another of said receiver ports being in communication with both said other chamber (53) through one of said manifold ports (14) and with one of the tranmistter ports (2) of a next pair of transmitter ports (2,4) to be coupled by said connecting means (61,62) with said high (29) and a low (29') pressure sources, respectively, to thereby effect a step-by-step displacement of said drive element.

* * * * *